United States Patent [19]

Briggs

[11] Patent Number: 4,571,747

[45] Date of Patent: Feb. 25, 1986

[54] HELMET WITH VISOR MECHANISM

[75] Inventor: Michael Briggs, St Albans, United Kingdom

[73] Assignee: Helmets Limited, St. Albans, United Kingdom

[21] Appl. No.: 581,740

[22] Filed: Feb. 22, 1984

[30] Foreign Application Priority Data

Mar. 4, 1983 [GB] United Kingdom ..... 8306034

[51] Int. Cl.[4] ..... A42B 3/00

[52] U.S. Cl. ..... 2/424; 2/6; 2/10

[58] Field of Search ..... 2/6, 10, 8, 424

[56] References Cited

U.S. PATENT DOCUMENTS 4,170,792 10/1979 Higgs ..... 2/6 X
4,199,823 4/1980 Jenkins et al. ..... 2/6 X
4,292,688 10/1981 Ellis ..... 2/6

FOREIGN PATENT DOCUMENTS 2937356 4/1980 Fed. Rep. of Germany ..... 2/424

*Primary Examiner*—Peter Nerbun
*Attorney, Agent, or Firm*—Birch, Stewart, Kolasch & Birch

[57] ABSTRACT

A locking and release mechanism for a helmet which, on release, permits rotation of the visor in either direction. The mechanism comprises an arcuate track (23) fixed to the helmet shell (11). The visor is preferably mounted on an arm (19) rotatable about an axis transverse of the shell and connected to a subsidiary arm (27) rotatable about the same axis. On the arm is a shoe (31) with a flat surface (37) opposing arcuate surface (25) of the track. Two interengaging operating members (45, 47) with respective guide surfaces are pivotally mounted on the shoe. Two outwardly biassed rollers (95, 97) are located between the opposed surfaces. Movement of the operating members against the rollers' biassing brings the guide surfaces into contact with the rollers and pushes them from wedging engagement to release the mechanism permitting rotation of the visor against low opposition from the rollers.

7 Claims, 4 Drawing Figures

HELMET WITH VISOR MECHANISM

The present invention relates to helmets and in particular to helmets with a locking and release mechanism for the visor or visors.

Protective helmets normally include one or more visors carried on the head shell for rotational movement between a raised storage position out of the line of sight of the wearer and a lowered position shielding the eyes or face of the wearer. For example, in an aircrew helmet, one visor could be a clear blast visor and the second a tinted glare visor. Ideally the visor or visors should be locatable in either of the two remote positions and usually one or more intermdiate positions. Various means of maintaining visors in these positions during a wearer's activities, during which considerable forces may be acting have be devised.

One locking and release mechanism is described in UK Patent No. 1,561,660 in the name of Helmets Limited. In that patent, a visor is mounted on the shell of the helmet for rotation about an axis extending transversely of the head shell. An arcuate track is located on one side of the shell centred on the visor axis and a shoe which rotates with the visor is mounted for movement along the track. The shoe has two inclined surfaces opposing the track forming a gap between the shoe and the track which is wider at the centre than at the ends. Two rollers and a spring biassing them apart are located in the space between the inclined surfaces of the shoe and the track. The spring biasses the rollers apart into the narrower sections of the gap between the shoe and the track. A control element having a manually operable knob is pivotally mounted on the shoe and has two side portions which are engageable with respective rollers. Initially the visor is locked in position because the two rollers are pushed apart so that they are wedged between the shoe and the track, preventing relative rotation. If the knob of the control element is moved, say, in the clockwise direction, a side portion engages its respective roller, pushing the roller towards the centre of the gap and out of wedging engagement. The side portion then abuts the shoe itself and continued pressure on the knob moves the shoe in the clockwise direction and the visor moves clockwise in conjunction with the shoe as pressure is maintained on the operating knob. The compressed spring pushes on the second roller, tending to force it into tighter wedging engagement, and in consequence the second roller offers frictional resistance to rotation. Conversely, if the knob is moved in the opposite direction, the second roller is pushed out of wedging engagement by its side portion and the shoe and visor move against some frictional resistance from the first roller in the anticlockwise direction if continued pressure is applied to the operating knob. On release of the knob, the biassing spring pushes the two rollers apart, thereby righting the control element and locking the shoe relative to the track.

The present invention provides an alternative locking and releasing mechanism for a visor on a helmet, which offers, in certain circumstances, advantage over the prior art.

According to the present invention there is provided a helmet comprising a head shell, a visor carried on the head shell, a mounting supporting the visor on the head shell and affording rotation of the visor about an axis extending transversely of the head shell and a visor locking and release mechanism, wherein said mechanism comprises a track fixed relatively to the shell, a first arcuate engagement surface formed on the track, a second engagement surface opposing said arcuate surface and rotatable with the visor about the axis of said arcuate surface, wedging means comprising two roller elements between the first and second engagement surfaces, biassing means biassing said rollers towards respective first positions, and control means having two operating members each provided with a guide surface, the operating members being manually movable against the action of the biassing means to bring the guide surfaces thereof into contact with the respective rollers so as to move the rollers from said first positions thereof to respective second positions thereof at which the spacing between the first and second engagement surfaces is greater than the spacing between those surfaces at the first positions of the rollers, whereby the wedging action of the rollers is released to permit rotation to a desired extent of the visor in either sense about said transversely extending axis whilst release of the operating members enables return to the first positions thereof of the rollers to cause renewed locking of the arcuate and second engagement surfaces.

Thus, the present invention provides a helmet having a visor locking and release mechanism which, when released, permits rotation of the visor in either direction as desired.

In addition to the means biassing the wedging means, second biassing means biassing the guide surfaces apart from one another may be included.

Suitably, the mechanism includes a shoe having the second engagement surface thereon, the shoe being mounted in relation to the track, and advantageously at least part of the second surface is planar. The axes of the visor and the arcuate surface would normally be coincident, but need not necessarily be so.

The invention will now be described by way of example with reference to the accompanying drawings showing one embodiment of a helmet in which.

Figure 1:
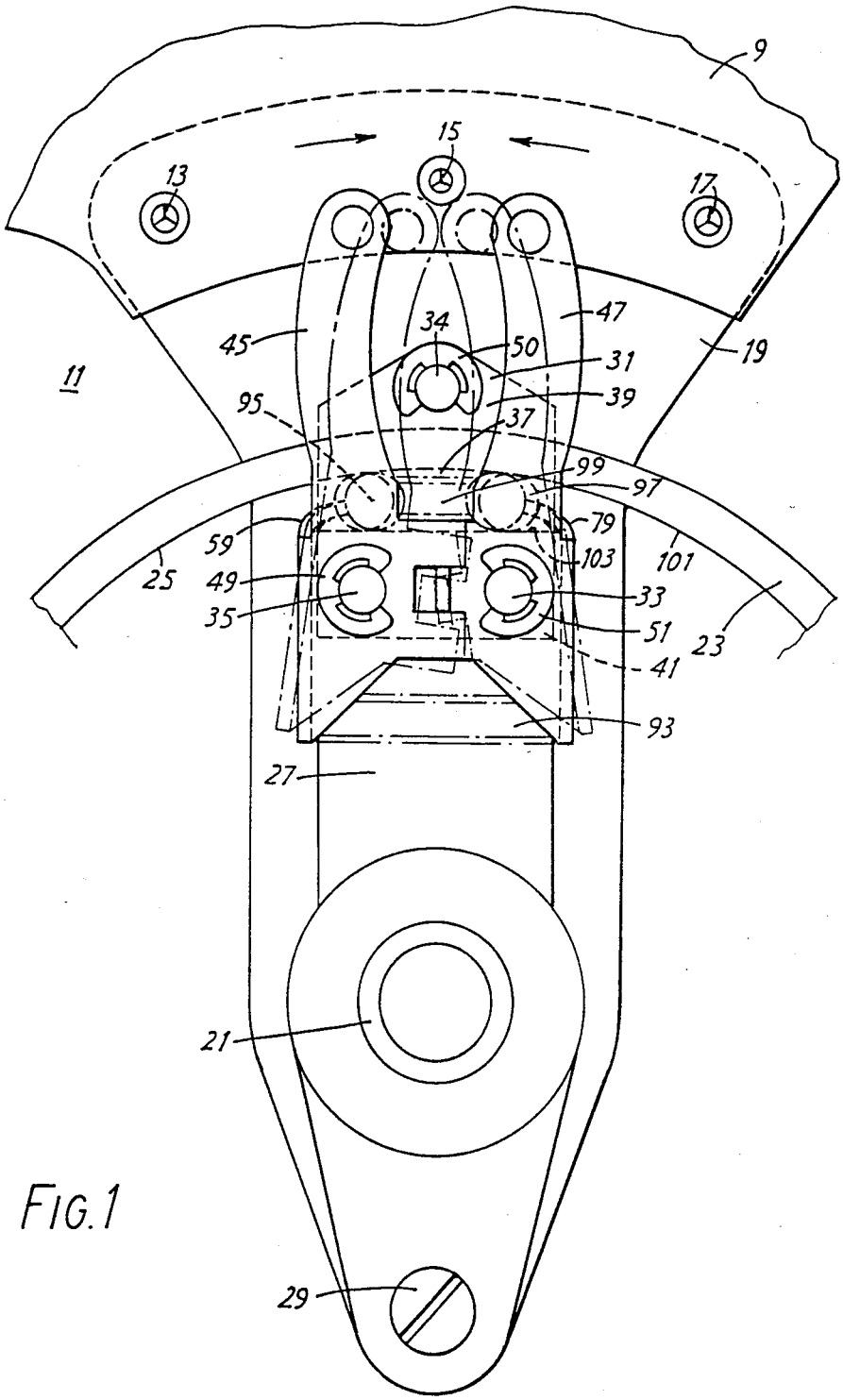
FIG. 1 is a fragmentary side elevational view of an embodiment of a helmet according to the invention showing a locking and release mechanism.

The general construction of the helmet, only part of which is shown in FIG. 1, is similar to that of the helmet illustrated and described in UK Patent No. 1,561,660, mentioned above, to which reference may be made.

The helmet comprises a generally rigid head shell 11 having two visors (one not shown) carried on the shell. Only part of the outwardly facing surface of one side of the shell is shown. Each of the visors has a separate mounting supporting it on the shell and affording rotation of the visor about an axis extending transversely of the shell. The mounting for one of the visors is shown in FIG. 1. The mounting for the second visor could be on the opposite side of the helmet, or alternatively on the same side as shown in UK Patent No. 1,561,660. In the following description no further mention will be made of the second visor which is controlled in a similar manner to the first.

The first visor 9 (only part shown) is connected by means of three screws 13, 15 and 17 in the free end of visor mounting arm 19. The arm is pivotally connected to the helmet shell 11 beneath a stud 21 for rotation between a raised and a lowered position.

The locking and release mechanism comprises an arcuate track 23 fixedly connected to the outer surface of the side of shell 11, with its axis centered on the axis of rotation of the arm 19. An angle of about 90° about this axis is subtended by the track. The inner surface 25 of the track forms an arcuate engagement surface.

The mechanism also includes an arm 27 which is pivotally connected to the helmet shell beneath stud 21 to rotate with the arm 19 about the same axis. The two arms are fixed together, to move in unison, by a fixing screw 29.

A shoe 31 is mounted on the opposite end of arm 19 and held to prevent any relative movement of the shoe and the arm by three pins 33, 34 and 35 having respective circlips 49, 50 and 51. The shoe 31 has a flat back portion 37 which lies in a plane behind track 23 and thicker top and bottom portions 39 and 41 which extend forwards from the plane of portion 37 out of the plane of FIG. 1. Portion 39 has an arcuate lower edge which engages the outer surface of track 23.

Two operating members or levers 45 and 47 are pivotally mounted on arm 27 and shoe 31, on pins 33, and 35 respectively. Levers 45 and 47 are shown in more detail in FIGS. 2, 3 and 4. Each lever has a front side which is seen in FIG. 1 lying in front of arm 27 and shoe 31 and a rear side behind the arm and shoe.

Figure 2:
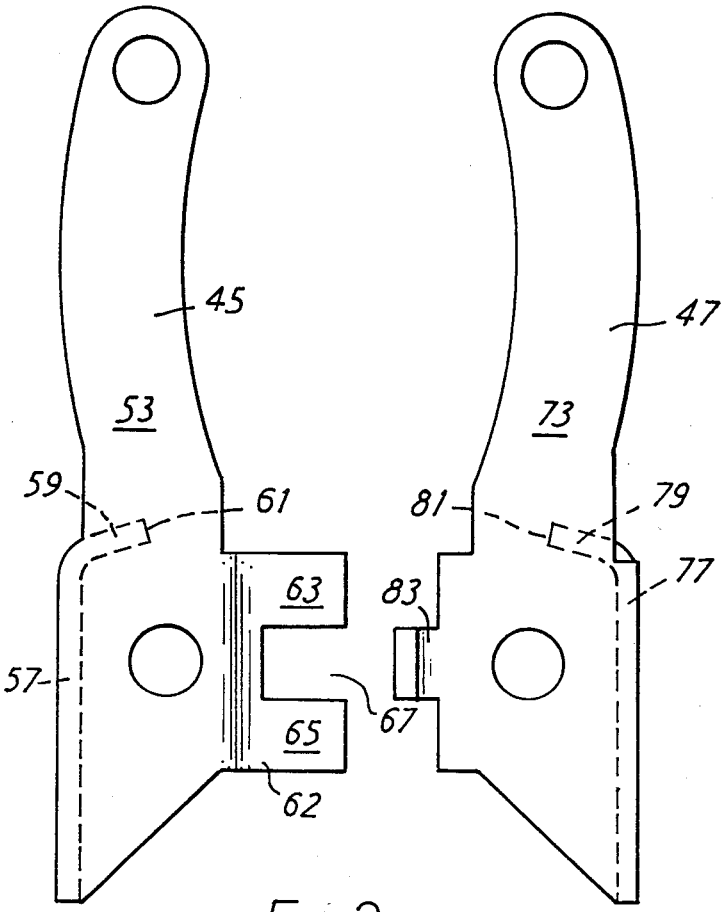
FIG. 2 is a side elevation view of two interlocking parts of the mechanism of FIG. 1 separated from one another.
Figure 3:
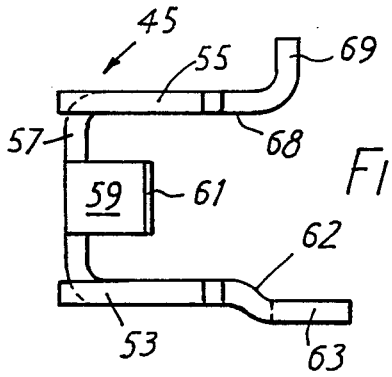
FIG. 3 is a plan view of the part on the left in FIG. 2.

Referring to FIGS. 2 and 3 which show member 45, this has a front arm 53 the upper section of which is curved and a similar rear arm 55, with the two arms rigidly connected by a side wall 57. Midway along the upper edge of the side wall 57 is an inwardly curving projection 59 having a guide surface 61 on its inner end. The lower section of member 45 is generally 'U' shaped in crosssection and the front and rear arms are both formed along their right-hand edges (as seen in FIGS. 1 and 2) with parts adapted to interengage with corresponding parts on the left of member 47. Front arm 53 has an extension 62 which is bent forwards. Upper and lower fingers 63, 65 of extension 62 are separated by a rectangular cut-out 67. On the rear arm 55, corresponding extension 68 is cut away at the top and bottom, leaving a tongue 69 of the same height as cut-out 67. The free end of the tongue 69 is curved outwards (see FIG. 3).

Figure 4:
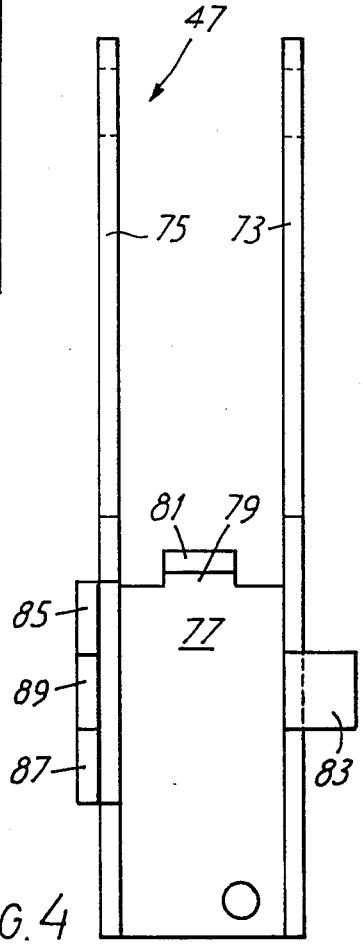
FIG. 4 is a side view from the left of the part on the right in FIG. 2.

Member 47, shown in FIGS. 1,2 and 4, is constructed in a similar manner to member 45. It has front and rear arms 73 and 75, a side wall 77 with a projection 79 and guide surface 81 all mirror images of the corresponding components of member 45. The extension on the front arm 73 has a tongue 83, which is bent forwards as seen in FIGS. 1 and 2, and fits as seen in FIG. 1 into the cut-out 67 in member 45. The rear arm 75 has fingers 85 and 87 bent out-wards slightly from the rest of the arm with a cutout 89 to accommodate tongue 69 on arm 55.

The two members 45 and 47 are connected at their lower ends to respective ends of a tension spring 93 which biasses the guide surfaces 61 and 81 and the upper ends of the arms 53, 55 and 73, 75 apart.

Two cylindrical rollers, 95 on the left and 97 on the right, (indicated by broken lines, since they lie behind arms 53 and 73) are located between the shoe 31 and the track and are biassed apart by a compression spring 99 so that the rollers are engaged by the lower arcuate surface 101 of the track and the upper flat surface 103 of the lower portion of shoe 31. The two surfaces 101 and 103 oppose one another and define a gap between them which is wider at the centre than at the sides. The rollers 95 and 97 are spaced slightly inwards from the guide surfaces 61 and 81 on members 45 and 47, respectively.

FIG. 1 shows the parts of the locking and release mechanism in two positions. In the position as indicated for the members 45 and 47 in full lines and for the rollers 95 and 103 in broken lines, the visor is locked in position, whereas for the position as indicated by chain-dotted lines, the visor is freed for rotation.

The operation of the embodiment of the invention illustrated is as follows. Suppose that initially the visor is locked in position and the members 45 and 47 are located as indicated by full lines in FIG. 1, that is to say with the upper ends of the members spaced apart. The rollers 95 and 103 are biassed apart by compression spring 99, so that they are tightly wedged between the arcuate surface 101 and the flat surface 103 on the shoe, and in this position, the rollers do not contact guide surfaces 61 and 81. The rollers are so tightly wedged as to prevent rotation of arm 27, thereby stopping the visor mounting arm 19 carrying the visor from rotating because of the rigid connection by pin 29 between the two arms. Even relatively large forces acting on the visor can be withstood, and the visor is effectively locked. Tension spring 93 holds the upper ends of the members 45 and 47 apart.

In order to release the lock, one or the other or both of the upper ends of members 45 and 47 are pushed inwards in the direction of the arrows in FIG. 1 towards the position as indicated by the chain-dotted lines. Movement of one member causes movement of the other by virtue of the interengagement by the interlocking of fingers 63 and 65 with tongue 83 and fingers 85 and 87 with tongue 69.

Consider first member 45. As one or both of arms 53 and 55 are pushed to the right (as seen in FIG. 1), the member pivots about pin 35 against the biassing of spring 93. The guide surface 61 is brought into contact with roller 95 and pushes that roller against spring 99 towards the wider part of the gap between surfaces 101 and 103. At the same time, member 47 pivots in the anti-clockwise direction and roller 97 is contacted and pushed by guide surface 81 to the left, also into the wider part of the gap. Thus the two rollers are moved simultaneously from their wedged positions and the resistance to rotation of the arm 27 is substantially reduced, as the resistance from the rollers themselves is very small. At the wish of the wearer, the members 45 and 47, still pushed together, can be moved in either direction. The rollers no longer provide resistance and the arm 27 rotates relative to the shell 11 of the helmet and track 23, the upper part 39 of shoe 31 maintaining contact with the outer edge of the track. The visor mounted on arm 19 is moved simultaneously and it can be relocated wherever desired. Once the new location is reached, the members 45 and 47 are released and they are returned to their original positions by springs 93 and 99. Spring 99 causes rollers 95 and 97 to move apart until they are wedged between surface 103 and the new section of the track surface 101, causing renewed locking.

The second visor could be supported by a second mounting arm similar to arm 19, with a subsidiary arm forming part of a similar visor locking mechanism. If mounted on the same side of the helmet, the arms of the two visors could be mounted on the same pivot axis and a single track (23) could be provided. Alternatively the two mechanisms could be provided separately on opposite sides of the helmet.

The locking and releasing mechanism illustrated and described has relatively few components, enabling straightforward construction. The whole mechanism can be lighter than prior art mechanisms, such as those shown in UK Patent No. 1,561,660 and this is of particular advantage for lightweight aircrew helmets.

If desired, part of the mechanism could be protected by a cover over the lower part of the mounting and subsidiary arms (19 and 27) and the arcuate track (23), with a slit to allow the arms of the operating members to project so that they can be manually controlled.

It will be appreciated that a large number of different embodiments of the invention could be constructed. Whilst the two operating members have been shown with interengaging parts both in front of and behind the shoe, there could be interengagement on one side only and on the other the members need not be in contact. Clearly the shapes of some of the parts could be varied. For example, instead of the engagement surface (103) on the shoe being flat, it could slope slightly towards the sides provided that each roller element has an outer location where it is wedged and an inner location where it is not. The operating members need not be pivoted, but could be adapted to move together or apart in a direction normal to the longitudinal axes of arms 19 and 27. The guide surfaces could be provided on parts separate from the operating members, and the rollers could be replaced by alternative wedging means. Instead of having two operating members, rollers or wedging elements, and guide surfaces there could be only one of each of these with suitable biassing so that the visor can be locked and released, and after repositioning the mechanism locks the visor in its new location.

I claim:

1. A helmet comprising:

(a) a head shell;

(b) a visor carried on the head shell;

(c) a mounting supporting the visor on the head shell and affording rotation of the visor about an axis extending transversely of the head shell; and (d) a visor locking and release mechanism; wherein said mechanism comprises:

(i) a track fixed relatively to the shell;

(ii) a first arcuate engagement surface formed on the track;

(iii) a second engagement surface opposing said arcuate surface and rotatable with the visor about the axis of said arcuate surface;

(iv) wedging means comprising two roller elements between the first and second engagement surfaces;

(v) biassing means biassing said rollers towards respective first positions; and (vi) control means having two operating members each provided with a guide surface, the operating members being manually movable against the action of the biassing means to bring the guide surfaces thereof into contact with the respective rollers so as to move the rollers from said first positions thereof to respective second positions thereof at which the spacing between the first and second engagement surfaces is greater than the spacing between those surfaces at the first positions of the rollers, whereby the wedging action of the rollers is released to permit rotation to a desired extent of the visor in either sense about said transversely extending axis while release of the operating members enables return to the first positions thereof of the rollers to cause renewed locking of the arcuate and second engagement surfaces.

2. A helmet as claimed in claim 1, including second biassing means biassing the guide surfaces apart from one another.

3. A helmet as claimed in claim 1, wherein the two operating members are each pivotally mounted relatively to the second engagement surface and interengage so that rotation of one or the other or both of the members releases the mechanism for rotation of the visor.

4. A helmet as claimed in claim 1, wherein the mechanism includes a shoe having the second engagement surface thereon, the shoe being mounted for movement along the first engagement surface of the track.

5. A helmet as claimed in claim 1, wherein at least part of said second engagement surface is planar.

6. A helmet as claimed in claim 5, wherein the visor supporting mounting comprises a support arm for the visor, and said locking and release mechanism includes a subsidiary arm fixedly connected to the support arm.

7. A helmet as claimed in claim 6, wherein the mechanism includes a shoe mounted in relation to the track, said shoe having the second engagement surface thereon and being fixedly connected to the subsidiary arm.

* * * * *